United States Patent [19]

Hitch

[11] Patent Number: 4,767,324

[45] Date of Patent: Aug. 30, 1988

[54] TRANSITION SECTION FOR MUFFLE FURNACE

[75] Inventor: Thomas T. Hitch, Lawrenceville, N.J.

[73] Assignee: General Electric Company, Schenectady, N.Y.

[21] Appl. No.: 53,898

[22] Filed: May 26, 1987

[51] Int. Cl.[4] ..... F27B 19/00

[52] U.S. Cl. ..... 432/171; 432/64; 432/144

[58] Field of Search ..... 432/136, 144, 145, 148, 432/171, 64

[56] References Cited

U.S. PATENT DOCUMENTS 3,041,056 6/1962 Beck .
3,138,372 6/1964 Beck .
3,179,392 4/1965 Beck ..... 432/171
3,410,544 11/1968 Beck .

OTHER PUBLICATIONS

ISHM '85 Special Session, "Furnaces, Atmospheres and the Firing Process," ISHM Technical Monograph Series 81185-7, The International Society for Hybrid Microelectronics 1985, Disneyland Hotel, CA, (Nov. 13, 1985).

Viewgraph: "Hipped Roof Design with Sparger Placement", courtesy Honeywell, Phoenix.

D. E. Pitkanen, "Non-Noble Base Metal Systems", p. K-8, Relevancy: Drawing Figure.

Watkins-Johnson, "Atmosphere Distribution-Removeable Exhaust Plenum", Courtesy of Watkins-Johnson (WJ).

Watkins-Johnson Sparger, "FIG. 6", Photo Courtesy of WJ, Additions by Hitch.

Engineering Drawing.

*Primary Examiner*—Henry A. Bennet

*Attorney, Agent, or Firm*—William Squire; James C. Davis, Jr.; Paul R. Webb, II

[57] ABSTRACT

A muffle furnace burnout section includes dual parallel spargers each having parallel first and second sparger sections. The region between the first and second sparger sections includes a thermal and gas barrier transition section secured to the spargers. The transition section is removable from the muffle with the sparger assembly as an integral unit. The transition section is adjustable and mates with a transition barrier plate secured within the muffle at the transition region.

13 Claims, 3 Drawing Sheets

TRANSITION SECTION FOR MUFFLE FURNACE

The U.S. Government has rights in this invention pursuant to contract N00024-82-C-5110 awarded RCA Corporation by the Department of the Navy.

This invention relates to muffle furnaces for heat treating material and more particularly, to transition sections for dividing a muffle furnace into multiple stages.

Muffle furnaces are well known and may include fixed transition sections which divide the muffle into multiple stages. The stages have different temperatures and gas atmospheres used for processing materials passing through the furnace. Muffle furnaces that include fixed transition regions are disclosed in U.S. Pat. Nos. 3,041,056; 3,138,372; and 3,179,392, by way of example. In one implementation, a multistage muffle furnace is required to evaporate residual solvents and react out residual organic material in the material being processed. These processes are usually carried out in the furnace in what is known as the burnout section. The material is then required to pass into a subsequent firing region at maximum temperature for final firing and processing of the material. Such furnaces are relatively long relative to their widths and may be, for example, 20 feet in length and 10 inches in muffle width.

These furnaces include a muffle envelope which is usually a tubular arrangement which extends for the length of the furnace. At the entrance, or mouth, of the furnace, there is an entrance curtain comprising upper and lower perforated plates for gas distribution. Further along into the furnace there may be structures referred to in the art as spargers. Spargers are structures which distribute gases to different portions of the burnout region. The spargers may be staged to create different atmospheres in different portions of the burnout region. In one implementation, a sparger comprises a main gas carrying tube which extends for the length of a given burnout stage having a gas inlet pipe coupled at one end and a port at the other opposite end coupled to a tubular gas distribution plenum. The gas distribution plenum comprises an enclosed rectangular in section tubular structure having openings therein along its length. The openings differ in aperture size to provide uniform distribution of the gas supplied from the gas tube port. The plenum distributes gas to the furnace volume directly beneath it.

An inert endless belt moves beneath the sparger for carrying the material to be processed through the gaseous atmosphere created by the sparger. The spargers are often removable from the furnace by sliding the entire structure out of the mouth of the muffle to permit periodic cleaning, adjustment, or repair.

Some furnaces may include multiple stage spargers which are capable of distributing the same or different gases to successive multiple stages. Such multiple stage spargers include gas distribution means for distributing the processing gases to the different stages. However, normally transition sections for providing a temperature gradient and gas separation between sparger sections in a burnout region are not provided. Different stages of the spargers are usually provided for purposes of providing the same or different gases to different sections of the muffle without a physical transition section between such stages because such sections are fixed in place and spargers need to be removed.

However, during reaction of the various atmospheres with the material being processed in the furnace, gases and reactant materials are given off into the furnace atmosphere and tend to contaminate the different structures in the furnace. The present inventor recognizes a need to provide a temperature gradient in a burnout region. However, present transition sections providing gas and thermal barriers between the different stages in a muffle to permit temperature gradients are not removable and, as mentioned, spargers in the burnout region need to be removable. A further problem is that transition sections in a burnout region tend to also become contaminated and present a problem in providing efficient operation of the furnace after extended use. The present inventor recognizes a need for providing a removable burnout region transition section for an elongated muffle for purposes of maintenance and rejuvenation and for dividing multiple stage spargers with a physical thermal transition section.

According to the present invention, a removable transition section for an elongated muffle which extends in a given direction and having a removable sparger is provided for preserving a temperature gradient between two successive stages of the muffle and for substantially inhibiting gas migration from one stage to the other through a transition region formed by the transition section. The transition section comprises a baffle plate adapted to be secured to the sparger and mate with and be releasably secured to the muffle at the transition region. The plate has an edge adjacent to and facing the transition region. The baffle plate serves effectively as a heat and gas barrier between the successive stages. A gas barrier tube is secured to the baffle plate extending along the edge transversely the given direction. The tube includes aperture means along the length thereof for directing a barrier gas into the transition region. The tube includes means adapted to be releasably secured to the source of the barrier gas external the muffle.

IN THE DRAWING

Figure 1:
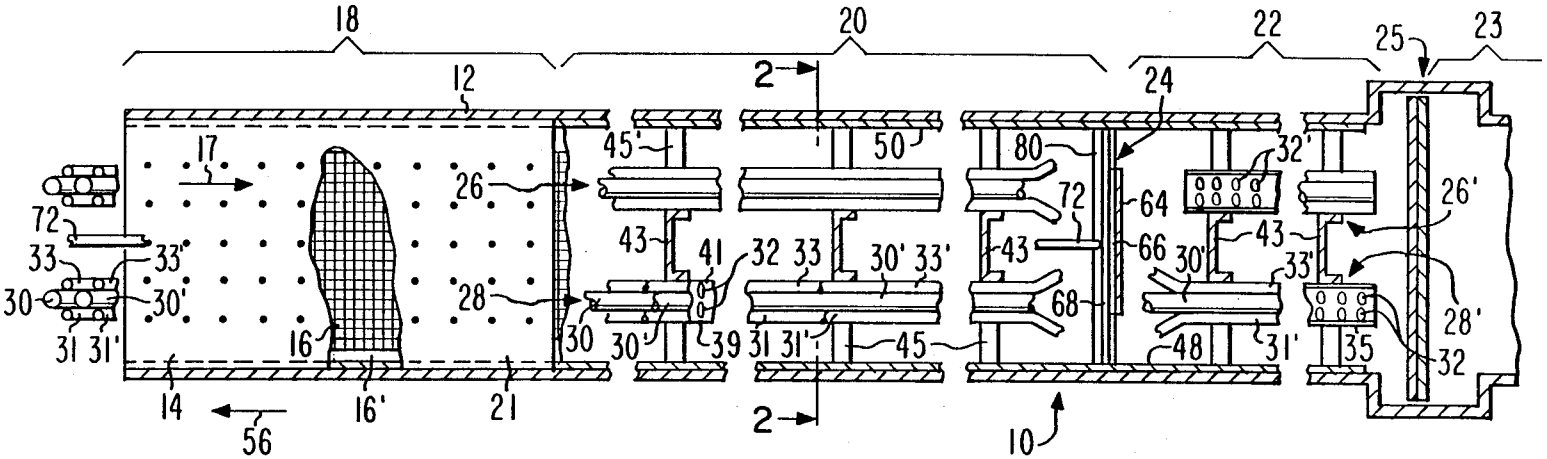
FIG. 1 is a fragmented plan sectional view of a muffle furnace including a removable transition section according to one embodiment of the present invention.

In FIG. 1 only so much of a belt muffle furnace 10 is shown as necessary for an understanding of the present invention. The furnace 10 includes an elongated tubular muffle envelope 12. The envelope 12 extends for the atmosphere containment portion of the furnace and may be over 20 feet in length. The envelope 12 has a mouth 14 which receives the material to be processed, for example hybrid integrated circuits, on an endless conveyor belt 16. The conveyor belt 16 may be a wire mesh or other material inert to the high temperatures and the gases in the different stages of the furnace. Belt 16 moves in direction 17 for transporting material through the furnace.

The furnace 10 includes an entrance curtain region 18 and successive stages including a first stage 20, a second stage 22 and a third stage 23. Not shown are subsequent cooling stages at the exit region of the furnace after stage 23. Each stage may be more than 5 feet in length.

The entrance curtain region 18 includes a perforated plate 21 above belt 16 and louvers (not shown) hanging from plate 21 and facing belt 16. A gas distribution system (not shown) distributes nitrogen gas to the curtain region. This region is at approximately ambient temperature. There is no physical barrier between curtain region 18 and stage 20 in the space directly above belt 16 and beneath plate 21. Stage 20 may have a nitrogen atmosphere and may be at a first temperature $T_1$, e.g., 350° C. The second stage 22 may have a nitrogen-oxygen atmosphere and may be at a second temperature $T_2$, e.g., 550° C. The third stage 23 may have a nitrogen atmosphere and may be at a temperature $T_3$, e.g., 900° C. Stages 20 and 22 are referred to as the burnout region. Stage 23 is referred to as the firing region. The burnout region removes contaminants and the firing region sinters the metal constituents and fuses the frit phases to form a thick film structure; e.g., multilayer thick film copper and compatible dielectric. Stages 20 and 22 are separated by a removable transition section 24, according to one embodiment of the present invention. Stage 22 is separated from stage 23 by a fixed standard transition section 25. The transition section 25 is secured permanently within the envelope 12 and is generally not removable from the muffle. The removable section 24 separates the furnace burnout region into two successive stages 20 and 22 having different temperatures and different gaseous atmospheres as described above.

Figure 2:
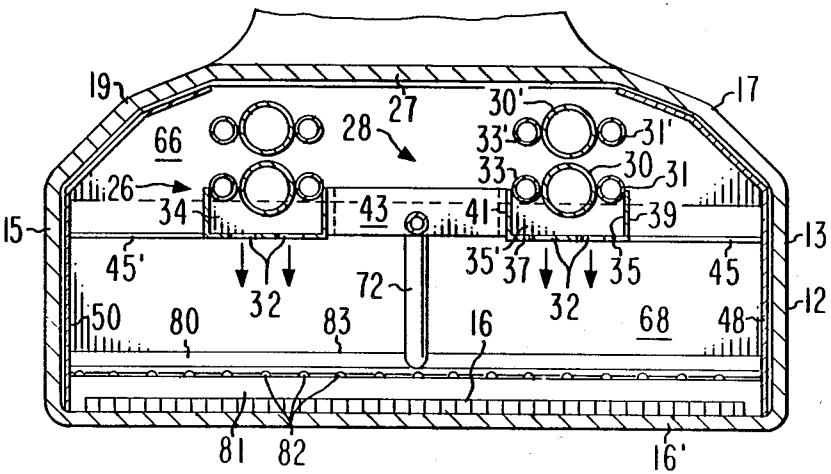
FIG. 2 is a sectional elevation view of the embodiment of FIG. 1 taken along lines 2—2.

In FIG. 2, the envelope 12 is a polygon having a bottom wall 16' on which the belt 16 slides. The envelope has two vertical side walls 13 and 15 and two inwardly sloping walls 17 and 19. The envelope is enclosed by a horizontal upper wall 27.

In FIG. 1, furnace 10 includes two like in-line pairs of spargers 26, 26' and 28, 28'. Sparger pair 26, 26' are on one side of the muffle and pair 28, 28' are on the other side. The pairs are substantially similar in construction and the description of one pair is representative. However, the curtain plates 21 (only one being shown) and the four spargers are integrally connected into one removable structure as will be described. The sparger pairs 26, 26' and 28, 28' are equidistant from the center of the furnace in plan to provide two parallel material processing regions which extend along the length of the furnace burnout region. The individual spargers of sparger pair 26, 26' and of pair 28, 28' are generally of a known design and only so much thereof will be described herein as necessary for understanding the present invention. However, the sparger pairs 26, 26' and 28, 28' are unique and will be described below. The use of parallel adjacent spargers, e.g., 26 and 28, however, is known.

Spargers 26 and 28 are contained in stage 20 and spargers 26' and 28' are contained in stage 22, each running most of the length of its stage and terminating adjacent to the transition section 24. In FIG. 2, sparger 28, by way of example, includes a gas circular pipe 30 which runs for the length of sparger 28 through curtain region 18 and through the mouth 14 of the muffle. Two smaller diameter gas pipes 31 and 33 run generally parallel to and are welded to pipe 30 to form a gas tight upper wall for plenum 35. Plenum 35 is a rectangular in section enclosed tube having a bottom wall 37 two side walls 39 and 41, and a pair of end walls 35', only one of which is shown.

Plenum 35 terminates adjacent to the ends of section 20. Not shown is a transverse sparger support plate which supports spargers 26 and 28 adjacent to the interface of stages 18 and 20 in the upper portion of the muffle above the plane of plate 21. Wall 37 has a series of openings 32 therein to permit gas to flow against belt 16 and material carried thereby as shown by the arrows. Pipe 30 is releasably connected to a source of gas outside the muffle adjacent to the mouth. One of the pipes 31 and 33 is also connected to a source of dopant gas, the other of pipes 31 and 33 may not be used to carry gas. Pipe 30 has an opening (not shown) adjacent to and in communication with the end of plenum 35 which is furthest from the entrance mouth 14 to supply gas to the plenum 35.

Sparger 26 is similarly constructed as sparger 28 for directing a gas over belt 16. Sparger 26 has a plenum 34 which is also a rectangular-like tube and extends for about the same length as sparger 28 in stage 20. Spargers 26 and 28 are secured, e.g., welded, to centrally aligned spaced vertical channel-like brackets 43, which may be sheet metal. Sparger 28 is welded to horizontally oriented spaced ribs 45, e.g., sheet metal, which are welded to vertically oriented sheet metal leg 48. Leg 48 runs for the length of the muffle, FIG. 1, from mouth 14 to transition section 25. Sparger 26 is welded to horizontally oriented spaced ribs 45' which are welded to vertically oriented sheet metal leg 50. Leg 50 is parallel to leg 48, with the legs resting on bottom wall 16' of the muffle. Also welded to legs 48 and 50 are curtain plates 21, FIG. 1, and the transverse sparger support plate (not shown) mentioned above.

In FIG. 2, secured above pipes 30–33 of sparger 28 are similar respective pipes 30', 31' and 33' of sparger 28'. Pipes 30', 31' and 33' run from outside the muffle mouth through transition section 24 into stage 22 where they form sparger 28' with other structure similar to sparger 28.

Figure 6:
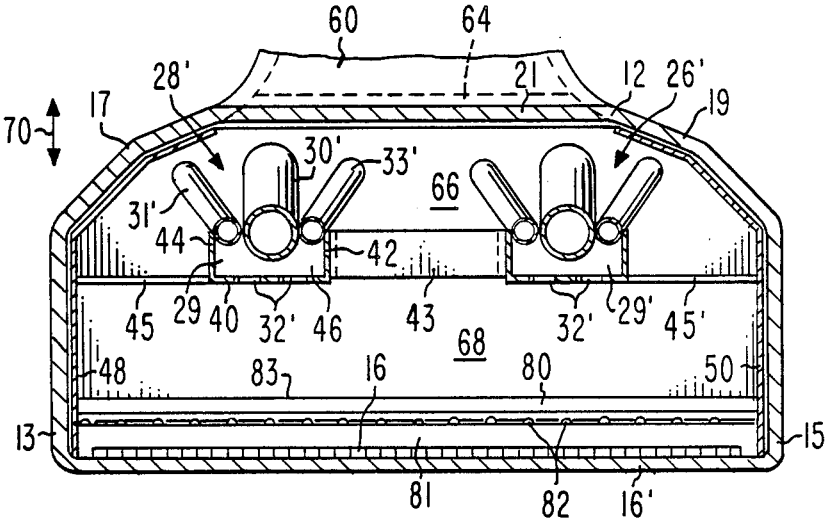
FIG. 6 is an end sectional elevation view of the embodiment of FIG. 3 taken along lines 6—6.

In FIG. 6, the sparger 28' plenum 46 has a bottom wall 40 and two upstanding side walls 42 and 44. The upstanding walls 42 and 44 are welded to respective pipes 33' and 31'. The pipes 31' and 33' are welded to pipe 30' to form the upper wall of plenum 46. The plenum of sparger 28' is enclosed by end walls 29 (only one being shown). Wall 40 includes a plurality of longitudinally spaced openings 32' for passing gas into the muffle furnace against belt 16 therebeneath along the length of the sparger. Pipes 30', 31' and 33' are welded to transition section 24 plate 66. The legs 48 and 50 are welded to and support the spargers and curtain plate on the bottom wall 16' of the muffle as an integral structure. The entire sparger structure including legs 48 and 50, spargers 26, 26', 28 and 28' and transition section 24 can be slideably removed from the muffle via mouth 14 in the direction of arrow 56, FIG. 1.

In operation of the spargers, gases, e.g., nitrogen, are supplied through pipes 30, 30' and dopant pipes 31, 31' and 33, 33' of each sparger pair from gas sources (not shown). Each of the pipes has a port (not shown) at the far end of each sparger plenum relative to the furnace mouth in communication with that plenum. The gas flows from the pipes through the ports into the corresponding plenum at one end of each plenum and flows along the length of each plenum through the openings 32 and 32', FIGS. 2 and 6, bathing the volume of the muffle therebeneath with the gases.

Not shown are heating elements which surround the muffle in sections for heating the different stages.

Figure 3:
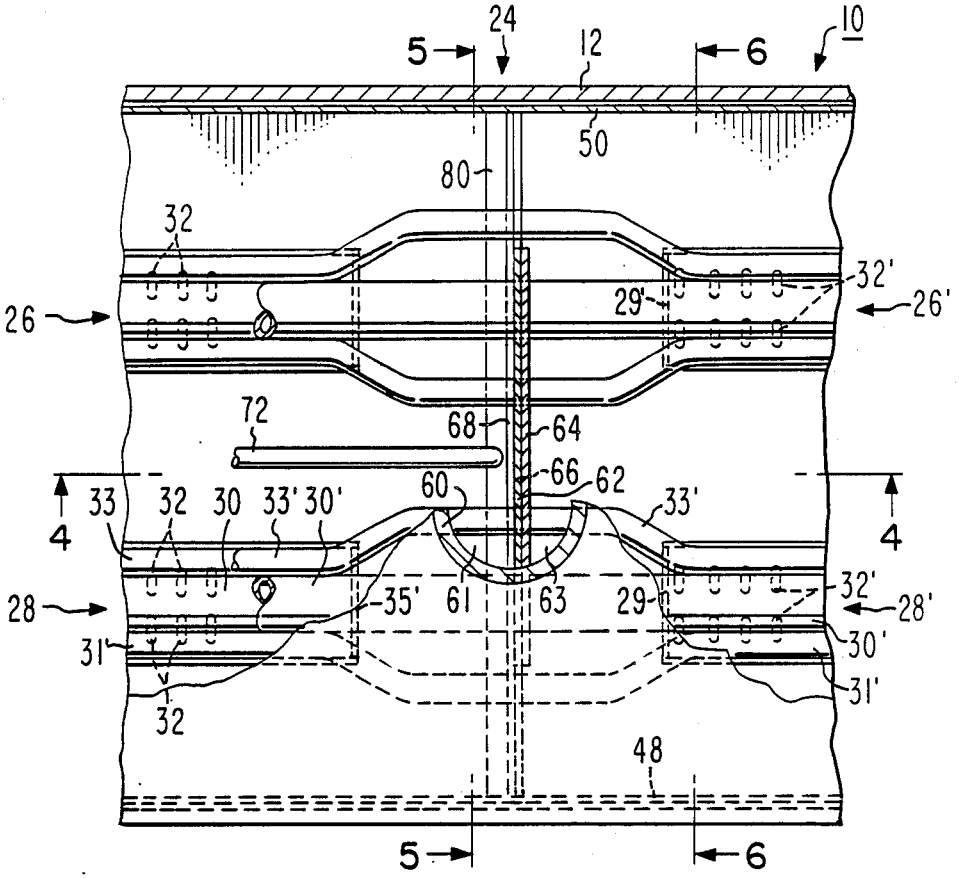
FIG. 3 is a plan view partially in section of the removable barrier transition section region of the muffle furnace of FIG. 1.
Figure 4:
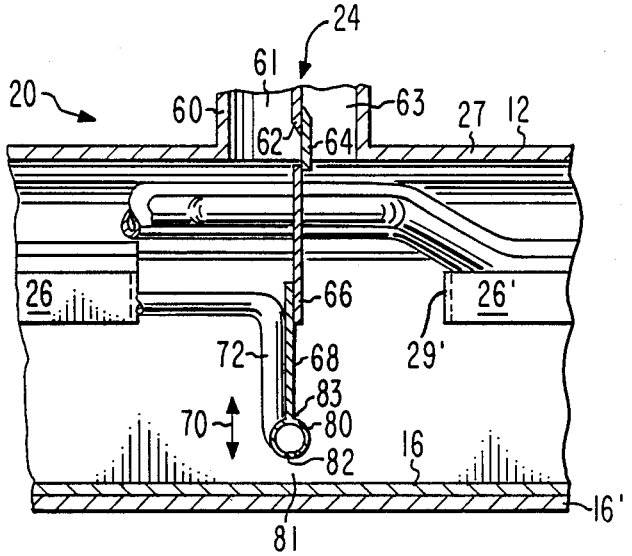
FIG. 4 is a sectional view of the embodiment of FIG. 3 taken along lines 4—4.
Figure 5:
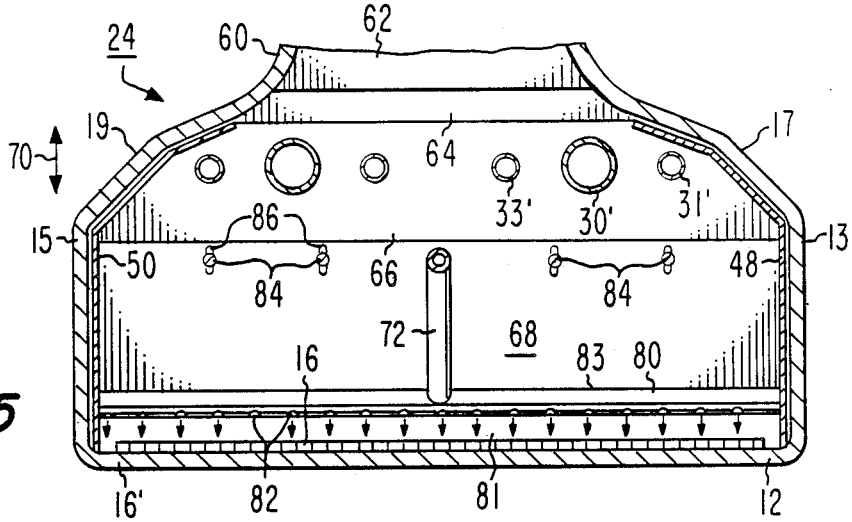
FIG. 5 is an end sectional elevation view of the embodiment of FIG. 3 taken along lines 5—5.

In FIGS. 4, 5 and 6, transition section 24 includes two parallel baffle plates 62 and 64 which divide exhaust stack 60. Plate 64 is welded to plate 62 both of which are welded to stack 60. Plate 64 may be welded to envelope walls 19 and 17 for added strength. Plates 62 and 64 divide stack 60 into two exhaust sections 61 and 63 (FIG. 3). Plates 62 and 64 extend transversely the length dimension of the muffle.

A baffle plate 68 is fastened to baffle plate 66 by screws 84, FIG. 5, and is vertically adjustable in directions 70 relative to plate 66 via slots 86 in plate 68. In the alternative plates 68 may be adjustably secured to plate 66 by other means, e.g., pins and holes. Gas pipe 72 is secured to plate 68, e.g., by welding. Pipe 72 is L-shaped at plate 68 and extends through the muffle mouth. Pipe 72 is coupled to a gas source (not shown) e.g., nitrogen. All pipes connected to the spargers and section 24 are releasably secured to couplings (not shown) outside the furnace mouth to various gas sources to permit the spargers to be removed from the muffle. A pipe 80 is welded to the lowermost edge 83 of plate 68. Pipe 80 extends transversely across the muffle above belt 16. Pipe 80 includes a series of spaced apertures 82 along the length thereof. Gas in pipe 80 is bathed over belt 16 as indicated by the small arrows adjacent thereto in the transition region 81 defined by the lowermost edge 83 of plate 68 and pipe 80. The gas supplied by pipe 80 may be nitrogen or other neutral gas for providing a gas barrier in region 81 between the two stages 20 and 22, (FIG. 1).

The gases in each of the sparger sections including the gas provided by pipe 80 are exhausted at section 24 via the exhaust stack 60 sections 61 and 63 on each side of the transition section 24, FIG. 3. Pipe 80 can be raised or lowered relative to belt 16 to flood belt 16 and the work pieces on it with the proper amount of gas in accordance with a given implementation. Plate 66 is secured to pipes 30', 31' and 33' of sparger 28' and the corresponding pipes of sparger 26' where these pipes pass through plate 66. Plate 66 is also welded to legs 48 and 50.

The transition section 24 comprising plates 66, 68 and pipe 72 is an integral part of the sparger assemblies. Plate 66, FIG. 4, abuts the fixed plate 64 to effectively form a gas barrier between sections 22 and 20. The plates 62 and 64 extend across stack 60 and the upper portion of the muffle 12. Plates 66 and 68 extend transversely across the muffle 12 width and terminate at regions spaced closely to the sidewalls of the muffle formed by envelope 12. These plates thus form an effective gas and thermal barrier between stages 20 and 22 of the furnace. The abutment of the plate 66 to plate 64 need not be gas tight. These plates may be spaced apart a small fraction of an inch, e.g., one eighth of an inch, and the plates still serve to effectively act as a gas and thermal barrier between the two stages. The degree of gas tightness, of course, is in accordance with a given implementation. The belt 16, has sufficient room to pass beneath distribution pipe 80.

Barrier gas is supplied in sufficient quantity and pressure to effectively isolate the atmospheres of the two stages 20 and 22 from each other in conjunction with exhaust stack 60. The barrier gas, as well as gases from the two stages, are sucked into the stack 60 by the buoyancy of the hot gases in the muffle and by venturis (not shown) in the exhaust stacks. Therefore, relatively negligible amounts of gases are permitted to pass from one stage to the other through the transition section 24.

While the transition section 24 is shown attached to the sparger sections as an integral unit therewith and is removable with these sections, it is apparent that the removable barrier may be attached to other supporting structure, not shown, which may also be removable. For example, the plates 66 and 68 may be attached to self-supporting structure similar to legs 48 and 50. This structure may stand within the envelope and include a portion adjacent the muffle mouth 14, FIG. 1, to be manually grasped for removal from the muffle. An important aspect is that the pipes 72 and 80 and plates 66 and 68 are removable so that they can be cleaned. Because the pipe 80 is located interior the muffle, sometimes as much as 10 feet or more inside the mouth 14, such a position is normally inaccessible due to the presence of the spargers and other structure in the furnace interior.

While the barrier gas is indicated as nitrogen, gases such as argon or other inert gases are also suitable. These gases are supplied under positive pressures to the transition section to provide a positive gas stream through pipe 80 onto belt 16. The nitrogen gas fills the transition region between pipe 80 and belt 16 with the neutral nitrogen gas and is at such a pressure as to preclude passage of gases from the stages 20 or 22 therethrough. Thus, the apertures 82 permit the nitrogen flow to provide a gaseous curtain of nitrogen which extends across the entire space faced by the pipe 80. The presence of this gaseous curtain precludes movement of the gases from stages 20 and 22 into one another and substantially prevents comingling of such gases and possible contaminants present therein.

Figure 7:
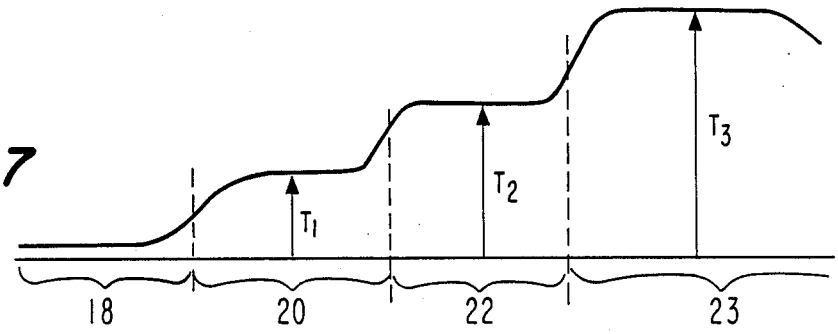
FIG. 7 is a chart showing a typical variation in temperature in the different stages of the muffle furnace embodiment of FIG. 1.

The presence of the negative pressure induced by the stack 60 forces the gases adjacent to the transition section 24 to exit the muffle in a positive flow. The removable transition section 24 provides a relatively sharp temperature gradient between the stages 20 and 22 as illustrated in FIG. 7.

While only one removable transition section is shown, it should be clear additional stages separated by additional removable transition sections may be included. For example, sparger 28 (and 26) are in one stage, sparger 28' (and 26') are in a subsequent stage, and spargers further into the furnace may be provided in the region now occupied by stage 23. In this case stages 20, 22 and 23 form a burnout region and stages 22 and 23 can be separated by a removable transition section similar to section 24. Additionally, the fixed transition section separates the burnout region from the subsequent firing region formed by present stage 23. For such additional sparger sections additional pipes may be added to provide the required gases to those sections. The removable plate portions of the removable transition sections in this case are dimensioned so as to not interfere with the fixed transition plate portions of the different transition sections as the spargers are slid out of the muffle during removal.

In implementations not requiring a transition section, such as section 24, then multiple sparger sections each downstream from the others may also be included. Such different sparger sections can provide different gases to different muffle stages, as needed.

What is claimed is:

1. A removable transition section for an elongated muffle, extending in a given direction and having a removable sparger, said section for preserving a temperature gradient between two successive stages of the muffle and for substantially inhibiting gas migration from one stage to the other through a transition region formed by the transition section, said section comprising:

a baffle plate adapted to be secured to the sparger and mate with and be releasably secured to the muffle at said region, said plate having an edge adjacent to and facing said transition region, said baffle plate serving effectively as a heat and gas barrier between said successive stages; and a gas barrier tube secured to the baffle plate extending along said edge transversely said given direction, said tube including aperture means along the length thereof for directing a barrier gas into said transition region, said tube including means adapted to be releasably secured to a source of said barrier gas external to said muffle.

2. The section of claim 1 further including a muffle barrier plate adapted to be fixedly secured to the muffle at said transition region, said muffle barrier plate being dimensioned and shaped to cooperate with the removable baffle plate to effectively form a gas and thermal barrier between said stages formed thereby.

3. The section of claim 1 wherein said muffle has a mouth spaced from said transition region, said section including transition section support means adapted to be releasably received in said muffle, said support means including a first portion located at said transition region and a second portion located adjacent said mouth for manual removal from the muffle through said mouth.

4. The section of claim 1 wherein said removable baffle plate comprises first and second plate members and means for adjustably attaching the second member to the first member for adjustably setting the magnitude of the transition region formed by said removable baffle plate.

5. The section of claim 1 wherein said sparger has two sections extending from and on either side of said transition region.

6. A removable transition section for an elongated muffle extending in a given direction from the mouth thereof, said section for preserving a temperature gradient between two successive stages of the muffle and for substantially inhibiting gas migration between the two stages through a transition region formed by the transition section, said transition section comprising:

a first baffle plate adapted to be fixedly secured to the muffle in said transition region, said baffle plate partially dividing and blocking the muffle in said given direction;

transition section support means adapted to be releasably received in said muffle, said support means including a portion located in said transition region adapted to be secured to a sparger for manual removal from said muffle;

a second baffle plate secured to said support means and adapted to cooperate with said first baffle plate to form effectively a heat and gas barrier thereat, said second plate having an edge adjacent to and facing said transition region; and a gas barrier tube secured to the second baffle plate and extending adjacent to said edge transversely said given direction, said tube including aperture means for directing a barrier gas into said transition region.

7. The section of claim 6 wherein said support means includes means which extend in said given direction along the length of the muffle, said support means including a portion located adjacent to the mouth of the muffle.

8. The section of claim 6 wherein said second baffle plate is dimensioned and shaped to abut the first baffle plate at said transition region.

9. The section of claim 6 wherein said support means comprises a dual section sparger having a first section in one muffle stage and a second section in a second muffle stage, said second baffle plate being secured to the sparger between said first and second sparger sections.

10. The transition section of claim 6 wherein said second baffle plate comprises a first plate member adapted to abut said first baffle plate and a second plate member adjustably secured to the first plate member for adjustably setting the opening magnitude of said transition region.

11. In a muffle comprising an elongated envelope and a plurality of successive stages within the envelope, a transition section defining a transition region, said section for preserving a temperature gradient between the successive stages and for substantially inhibiting migration of gas from one stage to the other through the transition region, said transition section comprising:

a first baffle plate adapted to be fixedly secured to the envelope in the muffle transition region;

a sparger comprising at least one section including a gas transfer tube and a plenum for receiving gas from the transfer tube, the plenum including opening means for distributing gas along the length thereof, said sparger including means for releasably securing it to said muffle in said envelope;

a second baffle plate secured to the sparger adapted to cooperate with the first baffle plate to form an effective thermal and gas barrier in said muffle, said second baffle plate having an edge extending across said muffle adjacent to said transition region; and an apertured barrier gas tube secured to said second baffle plate at said transition region for dispensing a barrier gas into said transition region, said tube including means for releasably securing it to a barrier gas source.

12. The transition section of claim 11 wherein said apertured barrier gas tube includes a portion which extends to said muffle mouth.

13. The transition section of claim 11 wherein said second baffle plate includes adjustment means for adjustably setting the magnitude of said transition region.

* * * * *